US005108295A

United States Patent [19]

Koike et al.

[11] Patent Number: 5,108,295

[45] Date of Patent: Apr. 28, 1992

[54] ELECTRICAL PLUG CONNECTOR WITH CONTACT STRIPS EMBEDDED IN INSULATOR PLATE FOR USE ON CIRCUIT BOARD

[76] Inventors: Kazumasa Koike, c/o Japan Aviation Electronics Industry, Limited, 21-6 Dogenzaka 1-chome, Shibuya-ku, Tokyo; Keiichiro Suzuki, c/o Japan Aviation Electronics Industry, Limited, 1-6, Dogenzaka 1-chome, Shibuya-ku Tokyo; Hironori Sunano, 4-3-13, Tezukayamaminami, Nara-shi, Nara, all of Japan

[21] Appl. No.: 670,294

[22] Filed: Mar. 15, 1991

[30] Foreign Application Priority Data

Mar. 16, 1990 [JP] Japan ..... 2-26162[U]

[51] Int. Cl.[5] ..... H01R 9/09

[52] U.S. Cl. ..... 439/79; 439/876

[58] Field of Search ..... 439/79, 80, 59, 62, 439/629, 630, 876; 29/884

[56] References Cited

U.S. PATENT DOCUMENTS

| | | | |
|---|---|---|---|
| 3,469,312 | 9/1969 | Leyssens et al. | 439/83 |
| 4,045,114 | 8/1977 | Dechelette | 29/884 |
| 4,201,432 | 5/1980 | Chalmers | 439/79 |
| 4,521,961 | 6/1985 | Roeschlein | 29/884 |
| 4,687,267 | 8/1987 | Header et al. | 439/62 |

FOREIGN PATENT DOCUMENTS

| | | | |
|---|---|---|---|
| 3134278 | 3/1983 | Fed. Rep. of Germany | 439/79 |
| 1431347 | 4/1976 | United Kingdom | 439/629 |

*Primary Examiner*—Neil Abrams

[57] ABSTRACT

A plug connector comprising a rigid insulator plate made of an electrical insulator, and contact strip members embedded in the insulator. The insulator plate comprises a mating portion for mating with a socket contact and a mount portion for mounting the plug connector on a circuit board. The contact strip members extend in a surface of the circuit board from the mating portion to the mount portion and are led out from the mount portion to provide connecting portion for electrically connecting with the circuit board. The top surfaces of the contact strip members are exposed in the surface of the mating portion and form contact surface for coming into contact with socket contacts of the socket connector mating with the mating portion.

6 Claims, 3 Drawing Sheets

ELECTRICAL PLUG CONNECTOR WITH CONTACT STRIPS EMBEDDED IN INSULATOR PLATE FOR USE ON CIRCUIT BOARD

BACKGROUND OF THE INVENTION

The present invention relates to electrical connectors for connecting circuit boards, and more particularly relates to a male or plug connector mounted on a circuit board.

A plug connector of a type described comprises an insulator housing to be mounted on a circuit board and a plurality of pin contacts secured to the insulator housing. The pin contacts are arranged at intervals and project from the insulator housing to thereby mate with female or socket contacts of a socket connector.

When it is requested or demanded to make the plug connector small and/or increase the number of pin contacts, each pin contact must be small sized or become thin. This results in that each contact pin is readily deformable by a decreased force applied thereto. Therefore, the plug connector has difficultly in use.

SUMMARY OF THE INVENTION

Accordingly, it is an object of the present invention to provide an electrical plug connector which is easy in use and simple in structure.

It is another object of the present invention to provide an electrical plug connector which plug contacts are small-sized without resulting in deformability.

An electrical plug connector for use on a circuit board according to the present invention comprises a hard insulator body having a mount portion for mounting said plug connector onto a circuit board and a mating portion integrally formed with said mount portion for mating with said socket connector, said mating portion having a surface in which a plurality of parallel grooves are formed to extend from an end portion to the mount portion, a plurality of contact strip members of the electrical conductor which are fitted and fixedly disposed in the grooves, respectively, each of the contact strip members being led out of the insulator body through the mount portion to thereby provide a connecting portion for being electrically connected to the circuit board.

DESCRIPTION OF PREFERRED EMBODIMENT

Figure 1:
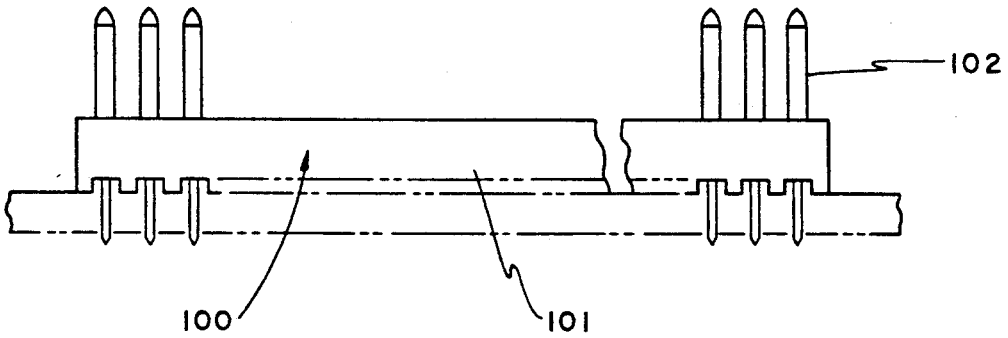
FIG. 1 (PRIOR ART)
FIG. 1 is a front view of a conventional plug connector used on a circuit board.

Referring to FIG. 1, a conventional plug connector 100 includes an electrically insulating housing 101 and contact pins 102 having the same form as each other and secured at equal intervals in parallel with each other into the housing so that the contact pins are separately erected and projected from the housing. The conventional plug connector has a problem described in the preamble.

Figure 2:
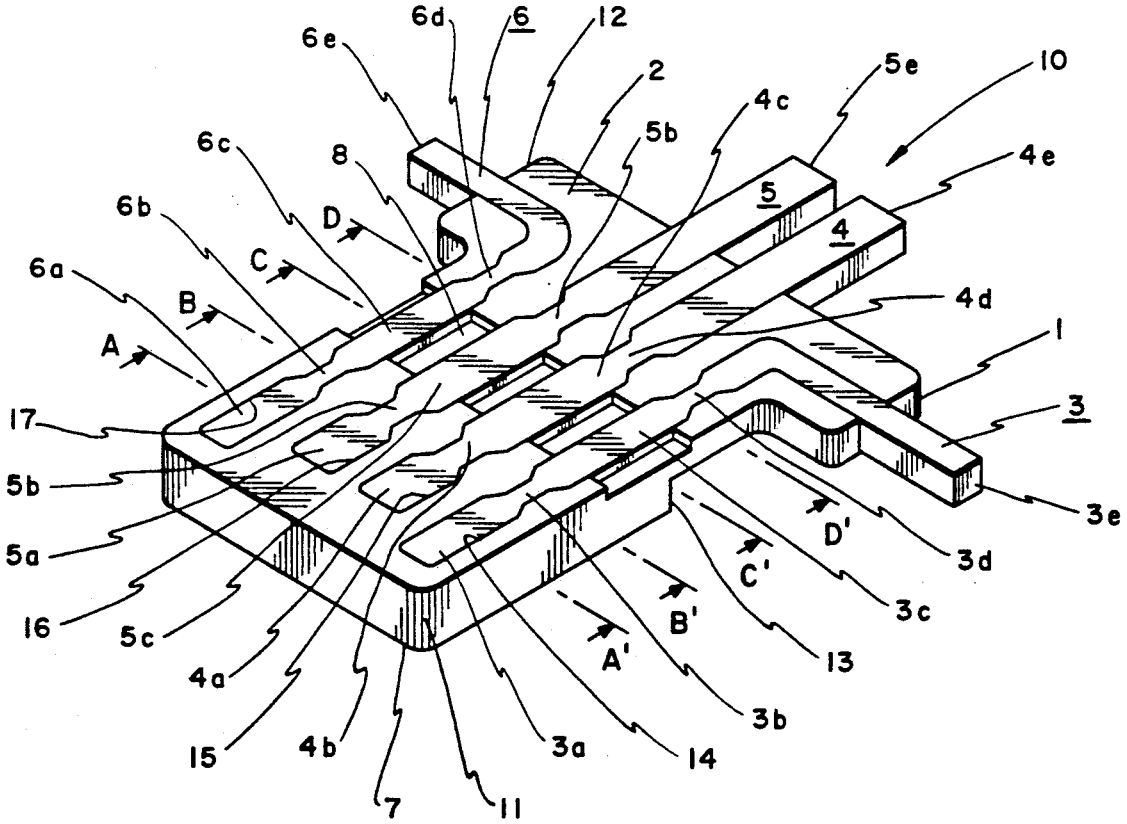
FIG. 2 is a perspective view of a plug connector according to an embodiment of the present invention.

Referring to FIG. 2, the plug connector 10 comprises a hard or rigid insulator body 1 made of an electrically insulating material and contact strip members 3, 4, 5 and 6 of an electrical conductor embedded in the insulator body 1.

Figure 3:
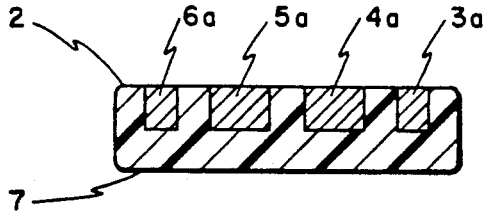
FIG. 3 is a sectional view taken along a line A–A' in FIG. 2.
Figure 6:
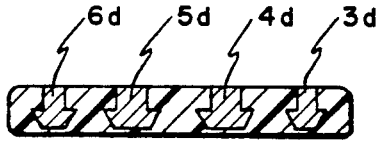
FIG. 6 is a sectional view taken along a line D–D' in FIG. 2.
Figure 7:
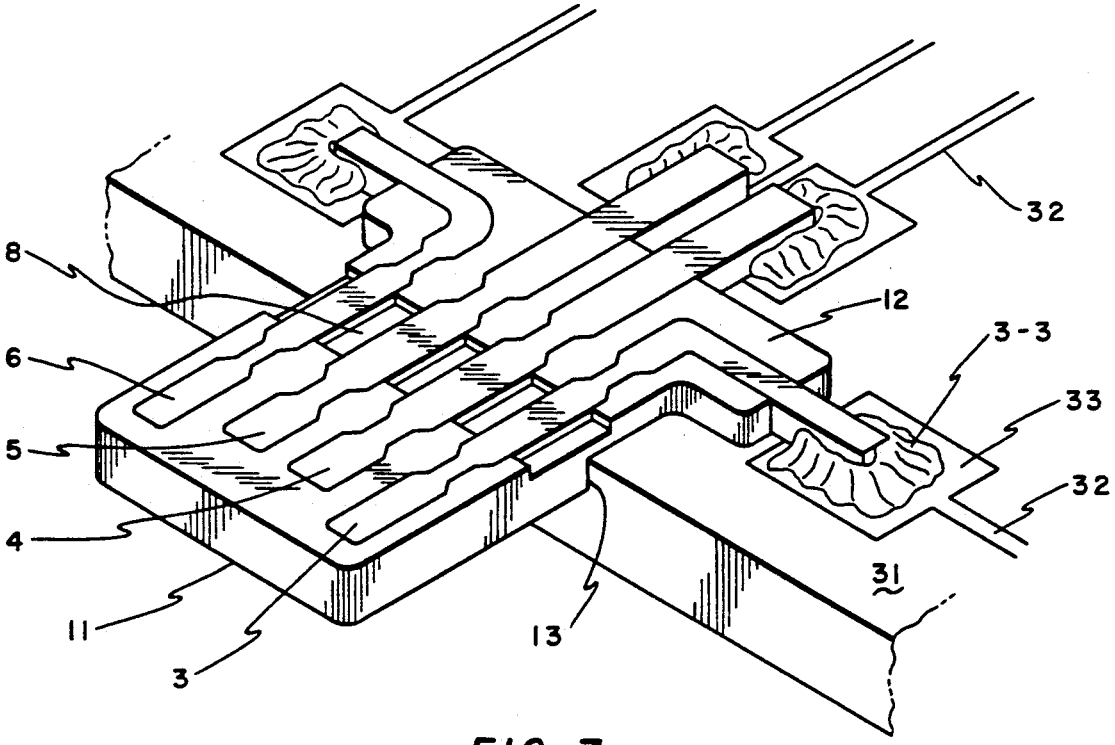
FIG. 7 is a perspective view of the plug connector mounted onto a circuit board.

In detail, the insulator body 1 is an insulator plate which comprises a mating portion 11 for mating with a socket connector (not shown) and a mount portion 12 for mounting the connector onto a circuit board (31 in FIG. 7). The insulator body 1 has a surface 2 extending over the mating portion 11 and the mount portion 12. The insulator plate 1 has an opposite surface 7 which has a stepped portion 13 so that the thickness of the mount portion 12 is smaller that the mating portion 11 (FIG. 2) and as will be understood from comparison of FIG. 6 with FIGS. 3–5.

In the surface 2 of the mating portion 11, a plurality of grooves 14, 15, 16 and 17 are formed in parallel with each other which extend to the mount portion 12. The grooves 14–17 are curved and deflected in different directions in the mount portion 12.

The contact strip members 3, 4, 5 and 6 are closely fitted and fixedly disposed in the grooves 14–17, respectively, (FIGS. 2–7). The contact strip members 3, 4, 5, and 6 are therefore juxtaposed with each other, and dispersed at the mount portion 12 and led out from the mount portion 12 in different directions. The contact strip members 3, 4, 5 and 6 have tip portions **3*e*, 4*e*, 5*e* and 6*e* projecting out from the end portion of the insulator body 1**, which are electrically connected to the circuit board.

Referring to FIGS. 3, 4, 5, and 6 in addition to FIG. 2, contact strip members 3, 4, 5 and 6 are closely fitted into grooves and embedded in the insulator plate 1 to nearly a half of the thickness of the plate 1 so that each of contact strip members 3–6 has a contact surface which is generally exposed and disposed at the same level of the surface 2 of the insulator plate 1.

In the shown embodiment, the contact strip members 3–6 generally have cross-sectional areas as shown at **3*a*–6*a* and 3*c*–6*c* which are set at optimal values for minute electrical current signals which flow through these contact strip members. Since those contact members 3, 4, 5 and 6 have no uselessly extended width, the interval between them or a distance between center lines of adjustment contact members is reduced so that the plug connector 10** is made compact.

Figure 4:
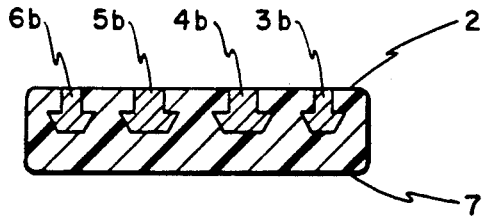
FIG. 4 is a sectional view taken along a line B–B' in FIG. 2.

The contact members 3, 4, 5 and 6 are partially formed thin or small-sized at portions **3*b*–6*b* shown in FIG. 4 and at portions 3*d*–6*d*. That is, each of those thin portions 3*b*–6*b* and 3*d*–6*d* is reduced by nearly a half of the width at a half of the thickness and the width of the other half of the thickness is increased so that the section is formed in the inverted T shape as shown in FIG. 4. Each of grooves are also formed in the inverted T shape at portions corresponding to thin portions 3*b*–6*b*** and 3*d*–6*d* of the contact strip members 3–6. The thin potions 3*b*–6*b* and 3*d*–6*d* act as hooks to prevent the contact members 3, 4, 5 and 6 from floating up from the insulator plate 1.

Figure 5:
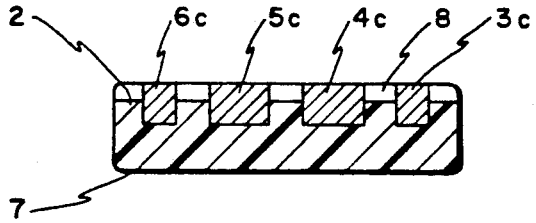
FIG. 5 is a sectional view taken along a line C–C' in FIG. 2.

Referring to FIG. 5, the insulator plate 1 has a recessed portion 8 extending in the direction of the width of the insulator plate 1 in the surface 2 so that the contact strip members 3, 4, 5 and 6 have portions 3*c*, 4*c*, 5*c* and 6*c* extending or projecting from recessed portion 8. For that reason, the surface of the projecting portions 3*c*, 4*c*, 5*c* and 6*c* of the contact strip members 3, 4, 5 and 6 are prevented from being completely fully embedded within the insulator plate 1. As a result, the projecting portions 3*c*, 4*c*, 5*c* and 6*c* of the contact members 3, 4, 5 and 6 can reliably be in contact with socket contacts.

Referring to FIG. 7, the plug connector 10 is mounted on a circuit board 31. In that state, the mount portion 12 of the plug connector 10 is mounted on the circuit board 31. The step portion 13 is engaged with an edge of the circuit board 31. The mating portion 11 projects outward from the edge of the board for mating with the socket connector. The projecting tip portions of the contact strip members 3, 4, 5 and 6 are connected by soldering on tabs 33 at the ends of circuit pattern lines 32 provided on the circuit board 31.

Figure 8:
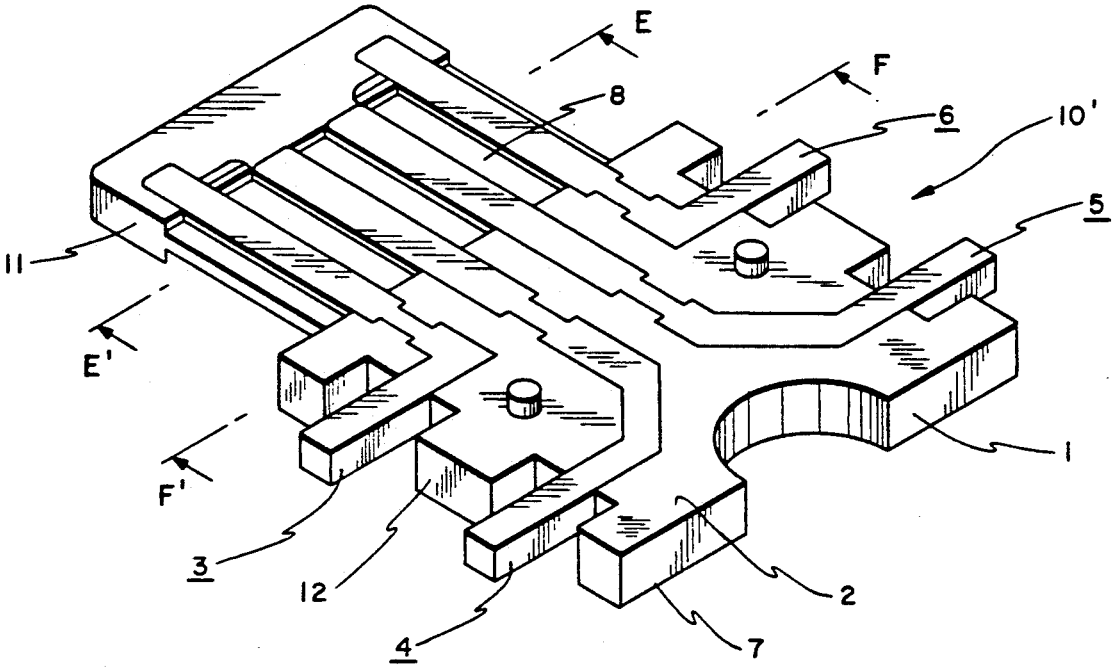
FIG. 8 is a perspective view of a plug connector according to another embodiment of the present invention.
Figure 9:
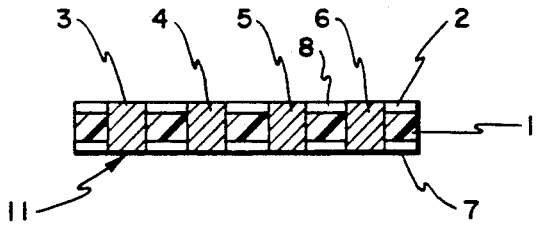
FIG. 9 is a sectional view taken along a line E–E' in FIG. 8.
Figure 10:
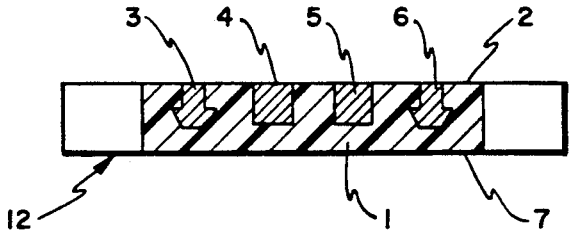
FIG. 10 is a sectional view taken along a line F–F' in FIG. 8.

Referring to FIGS. 8, 9, and 10, description will be directed to a plug connector according to another embodiment of the present invention. The plug connector comprises similar parts designated by like reference numerals.

The plug connector 10′ is different from the plug connector 10 of FIGS. 2–7 in that the mount portion 12 has thickness which is larger than that of the mating portion 11 as will be understood from a comparison of FIG. 10 with FIG. 9. Namely, the insulator plate 1 has a step between the mating and the mount portions 11 and 12 on the opposite surface 7 thereof.

Each of the contact strip members 3, 4, 5, and 6 has a first surface and a second surface opposite to the first surface. The first surface of each of the contact strip members 3, 4, 5, and 6 is generally exposed and extends from the mating portion 11 to the mount portion 12 along the surface 2 of the insulator plate 1 as will become clear from FIG. 8.

The second surface of each of the contact strip members 3, 4, 5, and 6 is generally exposed at the mating portion 11 and extends along the opposite surface 7 of the insulator plate 1 as will be understood from FIG. 9. However, the insulator plate 1 completely covers the second surface of each of the contact strip members 3, 4, 5, and 6 only at the mount portion 12 as will become clear from FIG. 10.

What is claimed is:

1. An electrical plug connector to be mounted on a circuit board for use together with a socket connector, said plug comprising:

a hard insulator body having a mount portion for mounting said plug connector onto a circuit board and a mating portion integrally formed with said mount portion for mating with said socket connector, said mating portion and said mount portion having a continuous flat surface at the same level in which a plurality of parallel grooves are formed to extend from an end portion to the mount portion;

a plurality of contact strip members of an electrical conductor which are closely fitted and fixedly disposed within said grooves, respectively, so that the contact strip members are embedded in said continuous flat surface of said insulator body, each of said contact strip members being led out of said insulator body through said mount portion to provide a connecting portion for being electrically connected to the circuit board, each of said contact strip members having a contact surface which is generally exposed and disposed at the same level as said continuous flat surface.

2. An electrical plug connector as claimed in claim 1, wherein said continuous flat surface is formed in said mating portion with a partially recessed portion so that each of said contact strip members partially projects from said recessed portion.

3. An electrical plug connector as claimed in claim 1, wherein each of said contact strip members is formed to have thin portions at intervals which are of a small size as compared with the size of the remaining portions therealong.

4. An electrical plug connector as claimed in claim 3, wherein each of said contact strip members has a section of an inverted T shape at each of said small sized thin portion and each of said grooves has a section of the inverted T shape at portions corresponding to said small-sized thin portions of said contact strip member.

5. An electrical plug connector as claimed in claim 1, wherein said insulator body is an insulator plate having said continuous flat surface extending over said mount portion and said mating portion, said mount portion being thinner than the thickness of said mating portion so that said insulator plate has a stepped portion on a surface opposite to said continuous flat surface.

6. An electrical plug connector as claimed in claim 1, wherein said insulator body is an insulator plate having said continuous flat surface extending over said mount portion and said mating portion, said mount portion being thinner than the thickness of said mating portion.

* * * * *